US006014882A

United States Patent [19]

Berger et al.

[11] Patent Number: 6,014,882

[45] Date of Patent: Jan. 18, 2000

[54] PROCESS AND DEVICE FOR ROLLING OUT THE ENDS OF A COILED STRIP IN A REVERSING ROLLING MILL

[75] Inventors: Bernd Berger, Kaarst; Franz Brüggen, Menden, both of Germany

[73] Assignee: Sundwiger Eisenhutte Maschinenfabrik GmbH, Hemer, Germany

[21] Appl. No.: 08/894,909

[22] PCT Filed: Feb. 9, 1996

[86] PCT No.: PCT/EP96/00534

§ 371 Date: Nov. 26, 1997

§ 102(e) Date: Nov. 26, 1997

[87] PCT Pub. No.: WO96/25251

PCT Pub. Date: Aug. 22, 1996

[30] Foreign Application Priority Data

Feb. 14, 1995 [DE] Germany ..... 195 04 711

[51] Int. Cl.[7] ..... B21B 41/06; B21B 39/08

[52] U.S. Cl. ..... 72/229; 72/205

[58] Field of Search ..... 72/229, 205, 365.2, 72/366.2, 226

[56] References Cited

U.S. PATENT DOCUMENTS

| | | | |
|---|---|---|---|
| 3,162,069 | 12/1964 | McLay et al. | 72/205 |
| 4,555,922 | 12/1985 | Ginzburg | 72/229 |
| 5,142,891 | 9/1992 | Kuwano | 72/205 |

FOREIGN PATENT DOCUMENTS

| | | |
|---|---|---|
| 0 466 570 A1 | 1/1992 | European Pat. Off. . |
| 58-58923 | 7/1983 | Japan . |
| 60-244417 | 4/1985 | Japan . |
| 60-102208 | 6/1985 | Japan . |
| 3226301 | 7/1991 | Japan . |

*Primary Examiner*—Joseph J. Hail, III
*Assistant Examiner*—Rodney Butler
*Attorney, Agent, or Firm*—Proskauer Rose LLP

[57] ABSTRACT

A method of rolling out the ends of a coiled strip in a reversing rolling mill having reels disposed on both sides thereof minimizes a length of strip at the strip ends having a non-conforming thickness. A start of the strip is introduced into the roll gap without inlet side strip tension and without rolling force at the start of each reduction pass. The rolling force is then gradually increased. The inlet side strip tension is subsequently reduced substantially to zero at the end of each reduction pass while the strip end still connected to the uncoiling reel, such that the strip end passes tension-free completely through the rolling gap and is consequently reduced in thickness. An apparatus for carrying out the method on a reversing mill includes a control system which selectively controls, via regulating and adjusting devices, the inlet and outlet strip tensions and the rolling force in a manner dependent upon respective locations of the start and end of the strip.

6 Claims, 1 Drawing Sheet

PROCESS AND DEVICE FOR ROLLING OUT THE ENDS OF A COILED STRIP IN A REVERSING ROLLING MILL

BACKGROUND OF THE INVENTION

When rolled out in a reversing rolling mill, strips coiled on reels are normally rolled with high strip tensions. The strip tensions are applied by the reels, alternately acting as coilers and uncoilers. To enable the tensions to be introduced into the strip on the coils, at least approximately 1.5 to 2 windings of the strip are coiled on the coiling reel prior to the start of rolling or left on the uncoiling reel at the end of each reduction pass. Those lengths of the strip to be rolled which are situated on the reel and also the strip length between the reels and the rolling mill remain unrolled. Since they are of the wrong dimensions, unrolled strip lengths with the thickness of the starting material are cut off on completion of rolling and represent an appreciable loss of material.

To obviate or at least clearly reduce the cutting-off of the strip ends of incorrect dimensions and the resulting loss of material, various methods have been developed for the rolling-out of the strip ends. In such methods known to the Applicants from practice the start and end of the strip are rolled out without strip tension.

In a first method the start of the strip is rammed to the preadjusted roll gap. Ramming is performed, for example, by means of driving rolls of different kinds or by means of ramming carriages. The rolled start of the strip is guided via deflecting flaps into a clamping slot of the coiling reel, when it is clamped and automatically coiled on. When 1 to 2 strip windings have been coiled, the required strip tension is applied on the inlet and outlet sides and the rolling operation continued with the required strip tension. Correspondingly, at the end of each reduction pass, when 1 to 2 residual windings have been completed on the unwinding reel, the inlet side strip tension is reduced to 0, the strip clamping on the uncoiling reel is released and the strip end is rolled until it leaves the roll gap. In the following reduction pass, this strip end forming the start of the strip is rammed into the roll gap as described. Such a method is known from JP-A 60-244417.

One disadvantage of that method is that malfunctions may occur when the start of the strip is rammed into the roll gap. For example, during insertion the start of the strip may become kinked and is therefore not rolled. Furthermore, when it leaves the roll gap, the rolled strip may be bent upwards or downwards like the tip of a ski and then be driven into the roll stand guides. Yet another disadvantage is that in the case of thin strips and high rolling forces, the prestressed rolls may collide and become damaged when the strip end runs out of the roll gap. To obviate the disadvantages described, in another method the strip ends are not rolled out over their whole length, but are halted immediately before they reach the roll gap. An unrolled piece of strip with the thickness of the starting material is therefore left, but it is short in comparison with the strip ends in the first-mentioned prior art method.

One disadvantage of this method is that the unrolled strip end, which is bent by the clamping slot of the uncoiling reel, remains bent, so that fresh insertion in the clamping slot is not readily possible. Nevertheless, to enable the strip end to be introduced into the clamping slot again, truing rolls are used which correct the kink caused by the clamping to such an extent that the start of the strip can be reinserted in the clamping slot. However, in the case of a very strong material the clamping slot cannot be aligned in this way.

In another prior art method wherein the strip end is also halted shortly before it reaches the roll gap, the strip end containing the kink from the clamping slot is cut off, for example, by means of cropping shears.

A disadvantage of the last-mentioned method is the considerable length lost, which comprises the unrolled piece of strip at each strip end, which corresponds to the distance between the cropping shears and the roll gap, and the ends cut off after each reduction pass. Another disadvantage is that the pieces of strip cut off must be disposed of for every reduction pass.

It is an object of the invention to provide a method and an apparatus for rolling out the ends of a coiled strip in a reversing rolling mill, whereby the lengths lost at the strip ends are small. Another object is to enable the method to be performed using the most inexpensive apparatus possible.

SUMMARY OF THE INVENTION

In a method of rolling out the ends of a coiled strip in a reversing rolling mill having reels disposed on both its sides, this problem is solved by the following features:

a) At the start of each reduction pass the particular start of the strip is introduced into the roll gap without inlet side strip tension and without rolling force.

b) After the particular start of the strip is introduced the rolling force is gradually increased.

c) At the end of each reduction pass, with the strip end still connected to the uncoiling reel, the inlet side strip tension is reduced to 0, the strip end passing tension-free completely through the roll gap and being at the same time reduced in thickness.

The invention also relates to an apparatus for the performance of the method, comprising a reversing rolling mill having reels disposed on both its sides, and also a control system with which adjusting members are associated on the reels for strip tension and on the rolling mill for rolling force, the control system so operating the adjusting members in dependence on the location of the start and end of the strip respectively that at the start of each reduction pass the particular start of the strip is introduced to the roll gap without inlet side strip tension and without rolling force; after the particular start of the strip is introduced the rolling force is gradually increased; at the end of each reduction pass, with the strip end still connected to the uncoiling reel, the inlet side strip tension is reduced to 0, the strip end passing tension-free completely through the roll gap and being at the same time reduced in thickness.

According to the invention, therefore, the thickness of the strip is reduced in the roll gap at the end of each reduction pass. In the next reduction pass this straightened strip end, which then forms the start of the strip, is not reduced in thickness over its whole length, like the following strip, since the start of the strip is introduced into the opened roll gap and the rolling force is only gradually increased. The result therefore is a start of the strip having a ramp-shaped cross-section. However, the dimensions of the ramp-shaped cross-section are not maintained, since at the end of the reduction pass it again moves completely through the rolling mill, being thereby reduced in thickness. The final result is that in this way a strip is obtained having comparatively merely short strip ends of incorrect dimensions, which are cut off. In addition to reducing the lengths lost, the invention also ensures that the start of the strip can be introduced in a problem-free manner into the clamping slot of the particular reel acting as an uncoiling reel, since the start of the strip is always straight, having passed completely through the roll mill in the preceding reduction pass. Extensive truing rolls are therefore not required.

According to one feature of the method according to the invention, the inlet and outlet side strip tension is increased up to maximum tensions only when the start of the strip is connected to the coiling reel. The maximum strip tension is reached only when at least 1 to 2 windings have been completed on the coiling reel.

The rolling force can be adjusted in such a way that it is so reduced at the end of each reduction pass that the rollers do not collide with one another when the strip end leaves the roll gap. Furthermore, a maximum limit value is given for the rolling force at the end of each reduction pass.

The invention will now be explained in greater detail with reference to a drawing showing diagrammatically an embodiment of the apparatus for rolling out the ends of a coiled strip.

DETAILED DESCRIPTION OF THE PREFERRED EMBODIMENT

Figure 1:
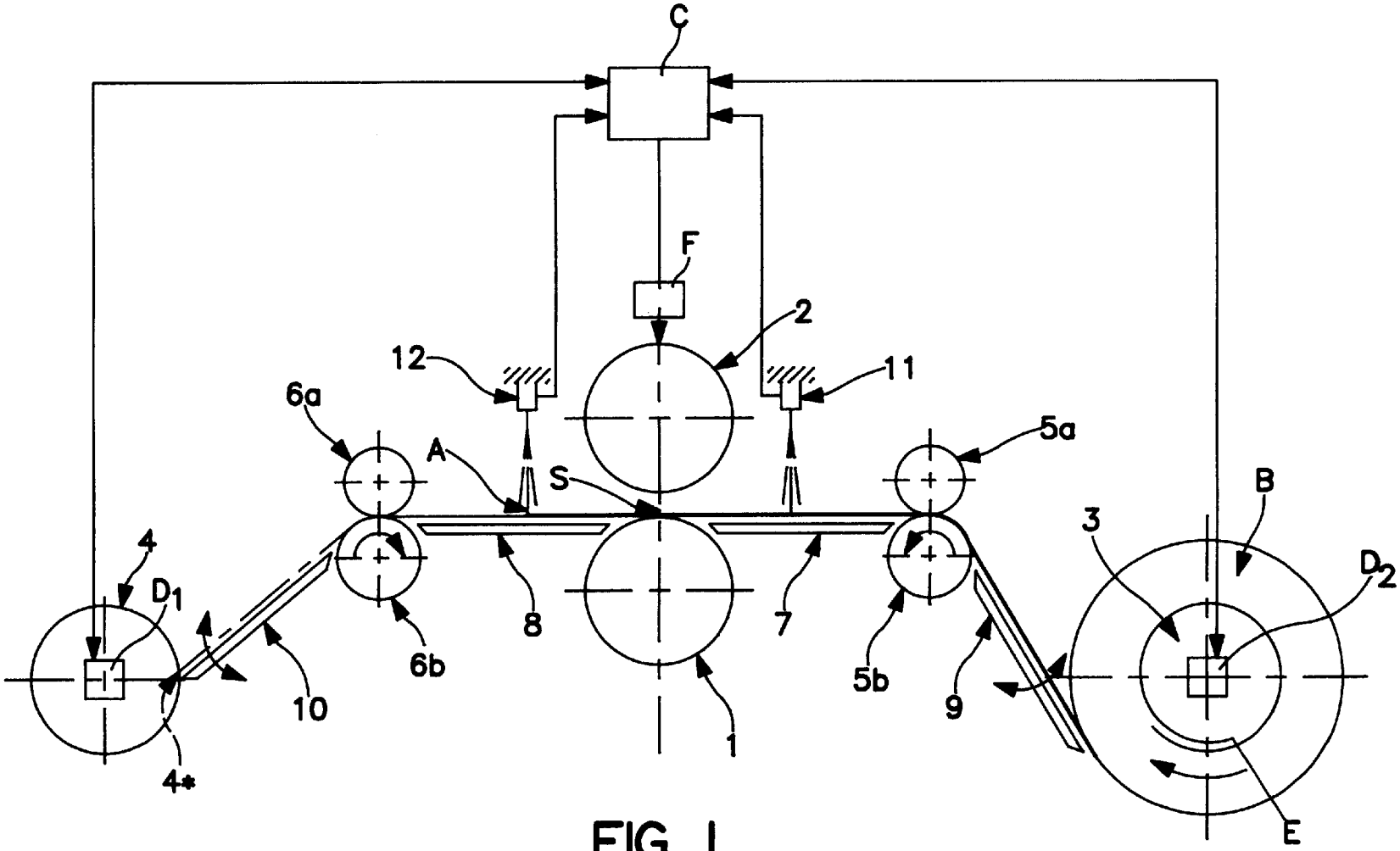
FIG. 1. is a schematic view of an apparatus for rolling out the ends of a coiled strip in accordance with an embodiment of the invention.

Referring now to FIG. 1, an apparatus for rolling out the ends of a coiled strip B consists of a reversing rolling mill having a lower roll 1 and an upper roll 2, two coiling reels 3, 4, pairs of driving rolls 5*a*, 5*b*, 6*a*, 6*b*, fixed deflecting tables 7, 8 immediately preceding the rolling mill 1, 2 on both sides, pivotable transfer flaps 9, 10 disposed between the coiling reels 3, 4 and the pairs of driving rolls 5*a*, 5*b*, 6*a*, 6*b*, a control system C for controlling adjustment of the rolling mill 1, 2 and the coiling reels 3, 4, and sensing elements in the form of light barriers. As shown in FIG. 1, the control system C receives signals from the sensing elements provided for example in the form of light barriers 11, 12 which are disposed above the deflecting tables 7, 8 on both sides of the rolling mill 1, 2, and sends signals to a device F for gradually adjusting the rolling force of the rolling mill 1, 2, typically provided, for example, in the form of hydraulic cylinders, and to drives $D_1$ and $D_2$ corresponding to coiling reels 4 and 3, respectively. Using such an apparatus, the method according to the invention is performed as follows:

With the roll gap S opened, as shown in the drawing, the start A of a strip B coiled on a coiling reel 3 is conveyed through the rolling mill 1, 2 by means of a pair of driving rolls 5*a*, 5*b*. As soon as the light barrier 12 detects the start A of the strip, the roll gap S is closed and a minimum rolling force applied which is sufficient to enable rolling to be started even without outlet side strip tension. The start A of the strip is then seized by the pair 6*a*, 6*b* of driving rolls and introduced via the pivoted-in transfer flap 10 into the clamping slot 4* of the coiling reel 4. At the same time the rolling force can be gradually increased. To stabilize the rolling operation, the inlet side strip tension can be increased simultaneously with the increase in rolling force. The extent to which the rolling force can be increased is determined by the clamping of the start A of the strip on the coiling reel 4. The full strip tension can be applied only after 1 to 2 strip windings on the coiling reel 4.

Parallel with the increase in the outlet side strip tension, the inlet side strip tension can also be increased, so that after 1 to 2 windings on the coiling reel the strip B is rolled with the required rolling force and the required strip thickness at the full inlet and outlet side strip tension. When the required strip thickness has been reached, a switch over can be made from roller force regulation to strip thickness regulation.

At the end of the first reduction pass—i.e., when another 1 to 2 windings have been coiled on the uncoiling reel 3—, at least the inlet side strip tension is reduced to 0. The strip end E then runs without inlet side strip tension into the closed roll gap S and is reduced in thickness at that place, so that it has the required strip thickness after leaving the roll gap S. At the same time the end E bent in the clamping slot is also straightened.

At the start of the second reduction pass, the straightened strip end E, which now forms the start of the strip, is introduced into the opened roll gap S and conveyed as far as the outlet side. As soon as light barrier 11 detects the strip end E, the roll gap S is closed and the strip is rolled as in the first reduction pass. Since the strip end forming the start of the strip A during the first reduction pass was introduced into the rolling mill with the roll gap opened, said end has a ramp-shaped cross-section. Since in the second reduction pass said end moves through the closed roll gap S, it is reduced in thickness and the bend from the clamping slot 4 is straightened. Since the strip end is thicker than the rest of the strip, the rolling force increases when the strip end passes through the rolling mill 1, 2. Steps must therefore be taken to ensure that a predetermined rolling force limit is not exceeded, which is related either to the maximum rolling force or to the rolling force of the steady rolling state. A switch over can therefore be made from thickness regulation to rolling force regulation. It is true that with constant force regulation the thickness of the strip end is reduced, but the quality of the ramp-shaped course is maintained.

The rolling of the strip proceeds correspondingly in the following passes.

What is claimed is:

1. A method of rolling out an end of a coiled strip in a reversing rolling mill, the rolling mill defining a roll gap and including reels disposed on both sides of the rolling mill, one of the reels serving as a coiling reel and another of the reels serving as an uncoiling reel during operation, the method comprising:

introducing a particular start of the strip into the roll gap without inlet side strip tension and without rolling force at the start of a reduction pass carried out in a particular direction;

gradually increasing the rolling force after the particular start of the strip is introduced into the rolling gap;

reducing the inlet side strip tension substantially to zero at the end of the reduction pass while an end of the strip still connected to the uncoiling reel; and passing the end of the strip tension-free completely through the rolling gap to effect a reduction in thickness thereof.

2. A method according to claim 1, further comprising gradually increasing the inlet and outlet side strip tension up to a maximum strip tension after the particular start of the strip has been connected to the coiling reel.

3. A method according to claim 1, further comprising preventing the rolling force from exceeding a maximum limit value during said step of passing.

4. A method according to claim 2, wherein the maximum strip tensions are effected only when at least 1 to 2 windings have been completed on the coiling reel and up to one to two windings are maintained on the uncoiling reel.

5. A method according to claim 4, wherein said step of reducing includes reducing the inlet side strip tension substantially to zero at the end of the reduction pass when there are less than one to two windings on the uncoiling reel.

6. An apparatus for rolling out an end of a coiled strip, comprising:

a reversing mill including a rolling mill defining a roll gap and reels disposed on both sides of the rolling mill, one of the reels serving as a coiling reel and another of the reels serving as an uncoiling reel during operation in which a start of the strip is introduced into the roll gap at initiation of a particular reduction pass and the coiled strip subsequently passed through the rolling mill from the uncoiling reel to the coiling reel to complete the particular reduction pass;

adjusting devices for selectively adjusting inlet and outlet strip tension;

a regulating device for regulating rolling force of the rolling mill, the regulating device permitting the rolling force to be gradually increased as desired; and a control system for operating the adjusting devices and the regulating device dependant upon respective locations of the start and an end of the strip such that at the start of the particular reduction pass the start of the strip is introduced to the roll gap without inlet side strip tension and without rolling force, the rolling force being gradually increased after the start of the strip is introduced, and at the end of the particular reduction pass, while the end of the strip is still connected to the uncoiling reel, the inlet side strip tension is substantially reduced to zero, whereby the end of the strip passes tension-free completely through the roll gap and is reduced in thickness.

* * * * *